United States Patent [19]

Takase et al.

[11] 4,033,109

[45] July 5, 1977

[54] TIME CORRECTION CIRCUITS FOR ELECTRONIC TIMEPIECES

[75] Inventors: Tsuneo Takase; Tetsuo Yamaguchi, both of Yokohama, Japan

[73] Assignee: Tokyo Shibaura Electric Co., Ltd., Kawasaki, Japan

[22] Filed: Nov. 20, 1975

[21] Appl. No.: 633,834

[30] Foreign Application Priority Data

| | | |
|---|---|---|
| Nov. 21, 1974 | Japan | 49-133131 |
| Nov. 21, 1974 | Japan | 49-133133 |
| Jan. 31, 1975 | Japan | 50-12374 |

[52] U.S. Cl. ..... 58/85.5; 58/23 R

[51] Int. Cl.[2] ..... G04C 3/00

[58] Field of Search ..... 58/23 R, 85.5, 50 R

[56] References Cited

UNITED STATES PATENTS

| | | | |
|---|---|---|---|
| 3,664,116 | 5/1972 | Emerson et al. | 58/50 R |
| 3,756,013 | 9/1973 | Bergey et al. | 58/38 |
| 3,810,356 | 5/1974 | Fujita | 58/23 R |
| 3,841,081 | 10/1974 | Komaki | 58/23 R |
| 3,928,959 | 12/1975 | Naito | 58/85.5 |

*Primary Examiner*—Robert K. Schaefer
*Assistant Examiner*—Vit W. Miska
*Attorney, Agent, or Firm*—Oblon, Fisher, Spivak, McClelland & Maier

[57] ABSTRACT

The time correction circuit comprises a switch, a first shift register circuit including two cascade connected shift registers driven by a 32 Hz clock pulse for shifting an electric signal generated by the operation of the switch, a second shift register circuit connected to the first shift register circuit and including two cascade connected shift registers driven by 1 Hz clock pulse for detecting the fact that whether the switch is maintained operated for an interval longer than a predetermined interval or not, a NOR gate circuit connected to receive the output from the two shift registers of the first shift register circuit, an AND gate circuit connected to receive the output signals from the first and second shift register circuits and a clock pulse having a predetermined frequency and an OR gate circuit connected to receive the output signals from the NOR gate circuit and the AND gate circuit.

10 Claims, 38 Drawing Figures

TIME CORRECTION CIRCUITS FOR ELECTRONIC TIMEPIECES

BACKGROUND OF THE INVENTION

This invention relates to a time correction circuit for an electronic timepiece, and more particularly to an electric circuit for correcting the time and date of an electronic timepiece.

With recent advance in the art of large scale integrated circuits (LSI) conventional mechanical timepieces are now gradually changing to electronic timepieces. Electronic timepieces are classified into a register type and a frequency division type and both types involve the problem of time correction. A number of methods have been proposed for effecting time correction. According to one method a mechanical switch is closed and opened to generate an electric signal which is applied to an electronic circuit for producing a digital signal which is applied directly or indirectly to a closed loop circuit or a frequency division circuit constituted by transistors or the like for correcting the hour, minute, second and date displays. In the mechanical switch the chattering interval of the switch occurring at the time of operation varies depending upon the mechanism and material of the switch. The switch in which the chattering interval is limited to be less than 30 milliseconds is expensive whereas the accuracy of the electronic timepiece wherein the chattering interval of the switch exceeds 30 milliseconds is low. For this reason, the chattering interval is generally set to be about 30 milliseconds.

Where a mechanical switch is used to correct the time, the switch is maintained in the closed state for a predetermined interval for producing a continuous electric pulse or operated intermittently for intermittently producing an electric pulse for effecting the time correction. When correcting the date or time, the method wherein the switch is maintained closed for a relatively long period can not correct small error whereas with the method wherein the switch is operated intermittently, it is necessary to depress the switch many times where the error is large.

SUMMARY OF THE INVENTION

It is an object of this invention to provide an improved time correction circuit for an electronic timepiece wherein the time or date is corrected at two speeds thereby accurately and rapidly correcting the time or date by providing a signal generating circuit which generates a series of pulses serving as a correction signal when a switch is maintained closed for more than a predetermined interval whereas each time the switch is closed for an interval shorter than the predetermined interval generates a single pulse serving as a correction signal.

According to this invention there is provided a time correction circuit for an electronic timepiece comprising a switch; a first shift register circuit including a plurality of cascade connected shift registers which are driven by a clock pulse having a first predetermined frequency for shifting an electric signal produced by the operation of the switch; a second shift register circuit including a plurality of cascade connected shift registers which are driven by a clock pulse having a second predetermined frequency lower than the first predetermined frequency for shifting the output signal from the first shift register circuit; a first logical circuit connected to receive the output signal from the shift registers of the first and last stages of the first shift register circuit for producing a pulse corresponding to the electric signal supplied to the first shift register circuit in response to the operation of the switch; and a second logical circuit connected to receive at least the output signals from the first and second shift register circuits and a clock pulse having a third predetermined frequency for producing clock pulses having the third predetermined frequency and of the number corresponding to the interval for which the switch is maintained open or closed when the switch is maintained open or closed for an interval longer than a predetermined interval.

BRIEF DESCRIPTION OF THE DRAWINGS

This invention can be more fully understood from the following detailed description when taken in conjunction with the accompanying drawings, in which.

DESCRIPTION OF THE PREFERRED EMBODIMENTS

Throughout the drawings the same or corresponding elements are designated by the same reference symbols.

Figures 1, 2A, 2B, 2C, 2D, 2E:
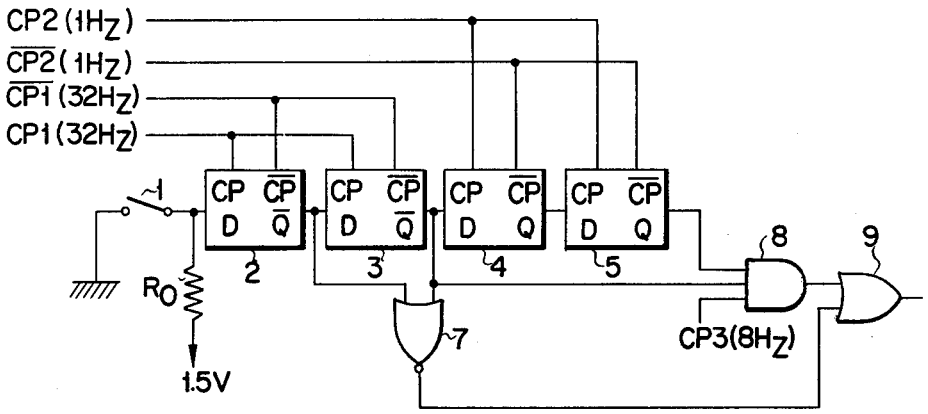
FIG. 1 is a block diagram showing a time correction circuit according to one embodiment of this invention for use in an electronic timepiece.
FIGS. 2A through 2E and FIGS. 3A through 3I are signal waveforms at various portions of the time correction circuit shown in FIG. 1 and are useful to explain the operation thereof.

One example of the time correction circuit shown in FIG. 1 comprises a switch 1, and a signal generating circuit which generates a time correction signal in response to the operation of the switch, the signal generating circuit comprising a first shift register circuit including serially connected shift registers 2 and 3 and a second shift register circuit including serially connected shift registers 4 and 5. The juncture between the switch 1 and the shift register 2 is connected to a source of −1.5V, for example, through a resistor $R_0$. The output terminals of the shift registers 2 and 3 are connected to different input terminals of a NOR gate circuit 7, and the output terminal of the shift register 3 is connected to one input terminal of an AND gate circuit 8, the other two input terminals thereof being connected to the output terminal of shift register 5 and a source of clock signal CP3 having a frequency of 8 Hz, respectively. The outputs from the NOR gate circuit 7 and the AND gate circuit 8 are coupled to the inputs of an OR gate circuit 9.

The time correction circuit shown in FIG. 1 operates as follows:

When the switch 1 is open, a voltage of −1.5V is impressed upon shift register 2, whereas when the switch is closed the voltage level of the input to shift register 2 becomes zero or charged to a high level.

To the CP and $\overline{CP}$ terminals of the shift registers 2 and 3 there are impressed clock pulses CP1 and $\overline{CP1}$, respectively, each having a frequency of 32 Hz. Thus, the signals applied to the input terminals D of these shift registers are written by the positive going transition of the clock pulse CP1 and read out by the negative going transition of the clock pulse $\overline{CP1}$ so as to shift the input signal. Since the output signals of shift registers 2 and 3 are taken out from their output terminals $\overline{Q}$ the input signal is inverted and delayed for producing the output signals. In the same manner clock pulses CP2 and $\overline{CP2}$, each having a frequency of 1 Hz, are impressed upon the CP and $\overline{CP}$ terminals of shift registers 4 and 5, respectively, whereby these shift registers shift the input signal under control of the clock pulses CP2 and $\overline{CP2}$. Since the output signals of the shift registers 4 and 5 are derived out from their output terminals Q the output signals are obtained in the form of delayed input signals.

Suppose now that the switch 1 is operated to generate a signal as shown in FIG. 2A. Then, the output signals from the shift registers 2 and 3 will have waveforms as shown in FIGS. 2C and 2D, respectively. Thus, the shift register 2 detects the closed state of switch 1 by the positive going transition of the clock pulse CP1 immediately following the depression of the switch as shown by FIG. 2B, thus producing a low level output a terminal $\overline{Q}$. This state is maintained until the open state of the switch 1 is detected by the immediately following positive going transition of the clock pulse CP1. Actually, however, the output signal wave does not build up so steeply as shown in the drawing but accompanies a more or less time lag so that the output signal delays slightly. For this reason, the output signal from the shift register 3 delays one shot, that is 1/32 second behind the output signal from the shift register 2. The output signals from the shift registers 2 and 3 are applied to the inputs of NOR gate circuit 7 so that each time the switch 1 is depressed, this NOR gate circuit produces a 1/32 second pulse as shown in FIG. 2E with a slight delay.

Figures 3A, 3B, 3C, 3D, 3E, 3F, 3G, 3H, 3I:
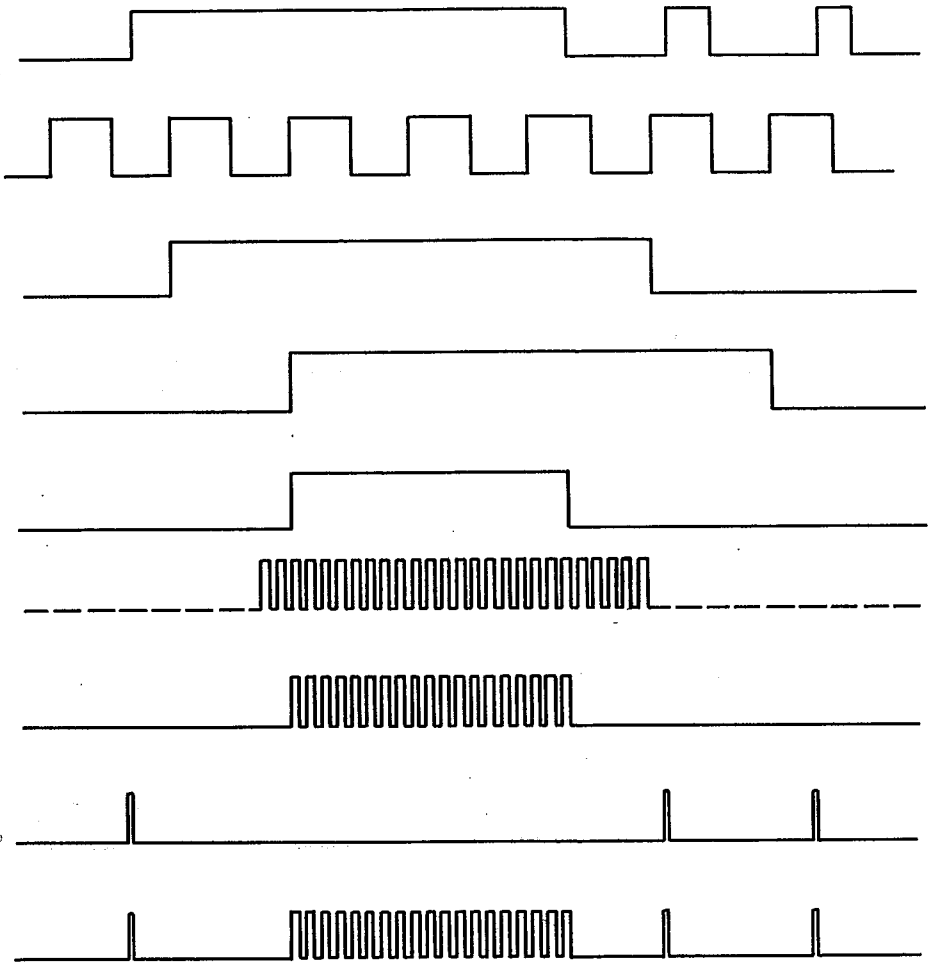

Let us consider a case wherein the switch 1 is operated such that it produces an electric signal as shown in FIG. 3A. As above described a signal delayed about 1/32 second behind that shown in FIG. 3A is applied to the shift register 4, but since this shift register is driven by 1 Hz clock pulses CP2 and $\overline{CP2}$ it can be thought that a signal substantially the same as that shown by FIG. 3A is impressed upon shift register 4. Accordingly, the shift register 4 detects the signal from shift register 3 at the positive going transition of the clock pulse CP2 immediately following the closure of the switch 1 and shown by FIG. 3B, thus producing a high level output at its output terminal Q. This high level state is maintained until the switch is opened and the shift register 4 detects the fact that the output signal from shift register 3 has changed to a low level at the positive going transition of clock pulse CP2 immediately following the opening of the switch. In this manner, shift register 4 produces a signal as shown in FIG. 3C. As shown in FIG. 3D, the output signal from shift register 5 lags one shot, that is 1 second behind the output signal from shift register 4. The output signal from shift register 5 is applied to the AND gate circuit 8 together with the output signal from shift register 3 and a clock pulse CP3 as shown in FIG. 3F and having a frequency of 8 Hz. FIG. 3E shows the waveform of a signal corresponding to the logical product of the outputs of shift registers 3 and 5. As a result, AND gate circuit 8 produces an output having a waveform as shown in FIG. 3G. In response to this output from AND gate circuit 8 and the output signal from the NOR gate circuit 7 as shown in FIG. 3H, the OR gate circuit 9 produces a pulse signal as shown in FIG. 3I and applies it to a counter (not shown) of the electronic timepiece for correcting the time thereof. Thus, OR gate circuit 9 produces one pulse each time switch 1 is closed, and a quick shift pulse or a pulse CP3 having a frequency of 8 Hz where the switch 1 is maintained in the closed state for an interval longer than a value lying between 1 and 2 seconds (in the case shown in FIG. 3, about 1.3 seconds) and where the output from the shift register 5 is at the high level or at 1 state.

Assume now that it is required to correct a time indication on a timepiece that has gained one minute. To this end, the minute digit is advanced 59 minutes without changing the hour digit. At first the output of the OR gate circuit is connected to the minute digit control circuit (not shown) of the timepiece. Under this state, the switch 1 is maintained in the closed state for about 7 to 8 seconds for advancing the minute digit by about 50 minutes and thereafter the switch is intermittently closed and opened for about 10 times thereby completing the time correction. This time correction can be made in about 10 seconds.

In this manner, according to this invention it is possible to rapidly and readily correct the time by the operation of a single switch.

Figures 4, 5A, 5B, 5C, 5D, 5E:
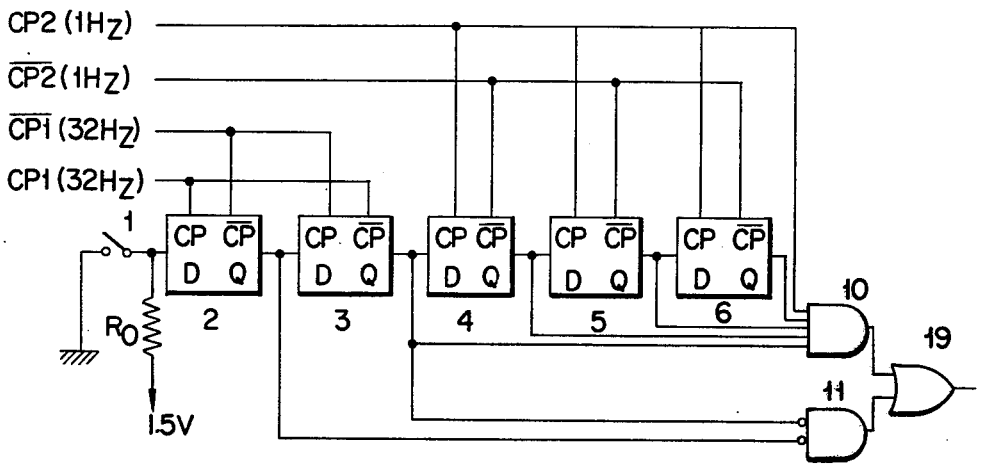
FIG. 4 is a block diagram showing a time correction circuit according to another embodiment of this invention.
FIGS. 5A through 5E and FIGS. 6A through 6J are signal waveforms useful to explain the operation of circuit shown in FIG. 4.
Figures 6A, 6B, 6C, 6D, 6E, 6F, 6G, 6H, 6I, 6J:
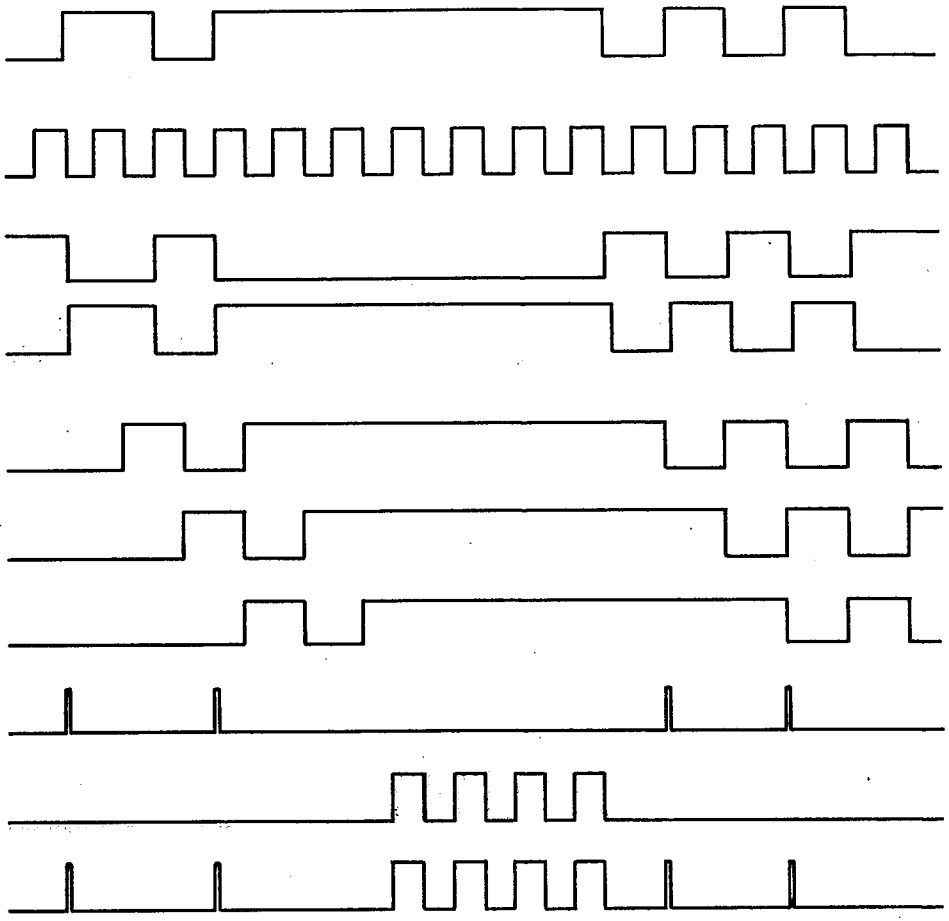

Although in the embodiment described above the first and second shift register circuits are connected in series it should be understood that it is also possible to connect these shift register circuits in parallel. Further, although clock pulses having frequencies of 32 Hz, 1 Hz and 8 Hz were used as clock pulses CP1, CP2 and CP3, it is also possible to suitably vary the frequencies of the clock pulses. For example, it is advantageous to use 1 to 10 Hz for clock pulse CP3. Further, in the above described embodiment, the second shift register circuit comprises two cascade connected shift registers so as to cause the OR gate circuit 9 to produce a quick shift pulse when the switch is maintained closed for an interval longer than 1 or 2 seconds, but it is possible to increase the number of the shift registers for generating the quick shift pulses only when the switch is maintained closed for longer interval. For example, in a modified time correction circuit shown in FIG. 4, the second shift register circuit comprises three cascade connected shift registers 4, 5 and 6 so that the quick shift pulse may be generated when switch 1 is maintained closed for an interval longer than about 3 seconds. In this modification, the shift register 2 operates to detect the electric signal (shown in FIG. 5) generated by operating the switch 1 at the negative going transition of the 32 Hz clock pulse CP1 shown in FIG. 5A and to shift this signal for producing an output signal as shown in FIG. 5C. The shift register 3 operates to detect the output signal from shift register 2 at the positive going transition of the clock pulse CP1 to shift this output signal for producing an output signal 1/64 second delayed behind the output signal from shift register 2 and shown by FIG. 5D. The outputs from shift registers 2 and 3 are applied to AND gate circuit 11 via inverters for causing the AND gate circuit 11 to produce an output pulse shown in FIG. 5E when the outputs from shift registers 2 and 3 are zero. Like the embodiment shown in FIG. 1, the output signal from shift register 3 is successively shifted by the succeeding shift registers. Thus, when a signal as shown in FIG. 6A is applied by the operation of switch 1 shift registers 2 and 3 produce output signals shown by FIGS. 6C and 6D respectively. The output from shift register 3 is shifted successively by shift registers 4, 5 and 6 by being detected at the negative going transition of the 1 Hz clock pulse shown in FIG. 6B whereby shift registers 4, 5 and 6 produce output signals shown by FIGS. 6E, 6F and 6G respectively. The outputs from shift registers 4, 5 and 6 are applied to the inputs of an AND gate circuit 10 together with the 1 Hz clock pulse CP2, so that this AND gate circuit produces a pulse as shown in FIG. 6I when all outputs from shift registers 3 to 6 are at the 1 level. The output from AND gate circuit 10 is applied to the inputs of an OR gate circuit 9 together with the output from an AND gate circuit 11 which is produced each time switch 1 is closed thus producing an output signal as shown in FIG. 6J which is applied to a counter (not shown) of the timepiece for effecting time correction thereof.

In the modification shown in FIG. 4, when the switch 1 is maintained closed for an interval longer than about 3 seconds, three connected shift registers 4, 5 and 6 produce a quick shift pulse or a 1 Hz clock pulse which is used for time correction, whereas when the switch 1 is maintained closed for less than about 3 seconds a narrow pulse is generated each time the switch 1 is closed which is also used for effecting time correction. In this manner, this embodiment operates substantially in the same manner as the previous embodiment except that the 1 Hz quick shift pulse is generated only when the switch 1 is maintained closed for an interval longer than about 3 seconds.

Although it has been stated that a 1 Hz clock pulse CP2 is applied to the AND gate circuit 10, it is also possible to apply a clock pulse having different frequency, for example, 1 to 10 Hz. Further, although the outputs from shift registers 4 and 5 are applied to the inputs of the AND gate circuit 10, it is not always necessary to do so.

Figure 7:
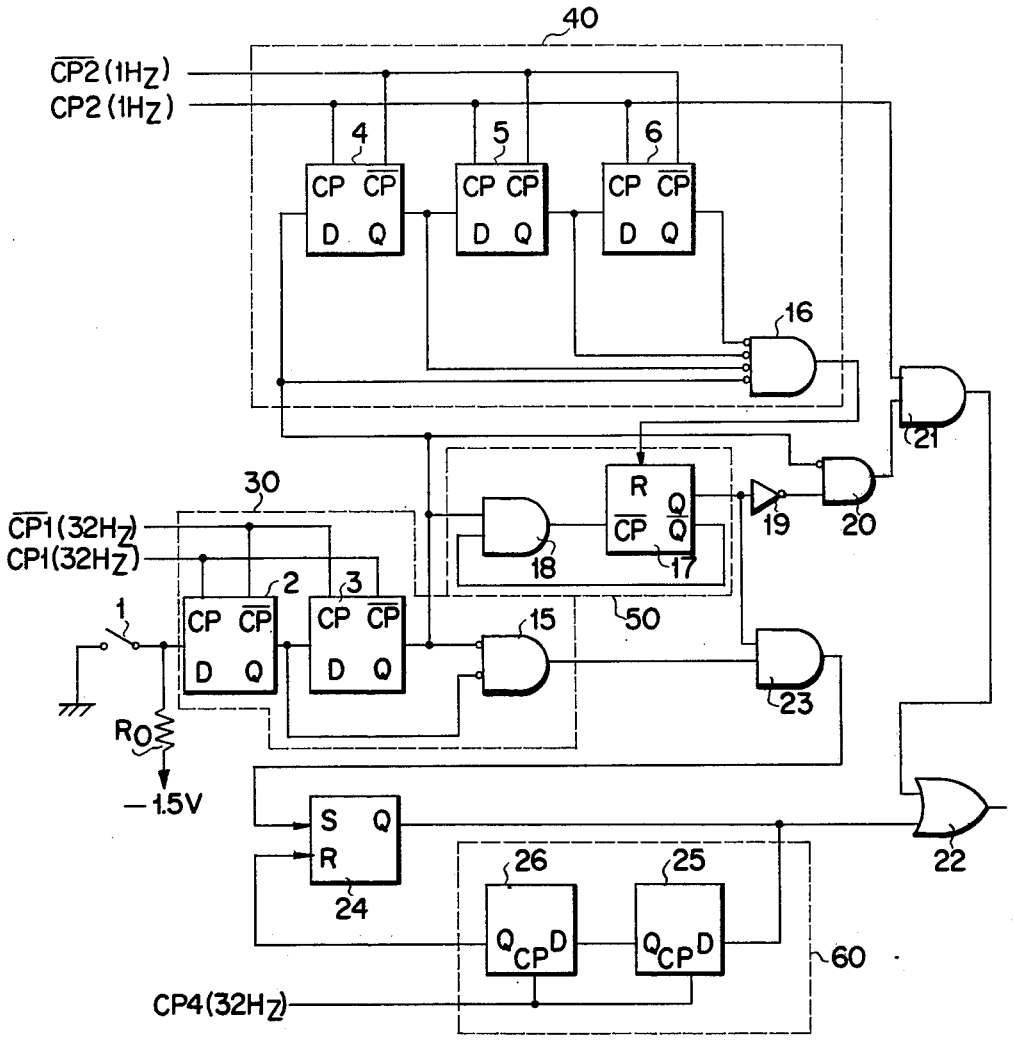
FIG. 7 is a block diagram showing still another embodiment according to this invention.

Turning now to FIG. 7 illustrating still another embodiment of this invention, there is provided a detection circuit 30 comprising two cascade connected shift registers 2 and 3 which are driven by clock pulses CP1 and $\overline{CP1}$ respectively, each having a frequency of 32 Hz, and a negative AND gate circuit 15. The detection circuit 30 detects the closure of switch 1 in the same manner as the shift registers 2 and 3 and the AND gate circuit 11 shown in the previous embodiments. Another detection circuit 40 including shift registers 4, 5 and 6 operates in the same manner as the shift registers 4, 5 and 6 of the previous embodiments to detect whether switch 1 has been maintained closed for more than 3 seconds. The outputs from shift registers 4, 5, 6 and 3 are connected to the input terminals of an AND gate circuit 16 respectively through inverters and the output terminal of the AND gate circuit 16 is connected to the reset terminal of a shift register 17. The $\overline{CP}$ terminal of shift register 17 is connected to the output terminal of an AND gate circuit 18 having one input connected to the $\overline{Q}$ output terminal of the shift register 3 and the other input terminal connected to the $\overline{Q}$ output terminal of the shift register 17. The AND gate circuit 18 and the shift register 17 constitute a flip-flop circuit 50. The output terminal Q of the shift register 17 is connected to one input of an AND gate circuit 20 via an inverter 19, and the other input terminal of the AND gate circuit 20 is connected to the output terminal $\overline{Q}$ of the shift register 3 via an inverter. The output terminal of the AND gate circuit 20 and 1 Hz clock pulse CP2 are connected to the input terminals of an AND gate circuit 21 and the output terminal of this AND gate circuit is connected to one input of an OR gate circuit 22. The output terminal of the AND gate circuit 15 of the detection circuit 30 is connected to one input terminal of an AND gate circuit 23 and the other input terminal thereof is connected to the output terminal Q of the shift register 17. The output terminal of the AND gate circuit 23 is connected to the set terminal S of a flip-flop circuit 24, the output terminal Q thereof being connected to the other input terminal of the NOR gate circuit 22. A pulse generating circuit 60 including serially connected shift registers 25 and 26 which are driven by a 32 Hz clock pulse CP4 is connected between the output terminal Q and the reset terminal R of the flipflop circuit 24.

The operation of the time correction circuit shown in FIG. 7 will now be described with reference to FIGS. 8A through 8F.

Figures 8A, 8B, 8C, 8D, 8E, 8F:
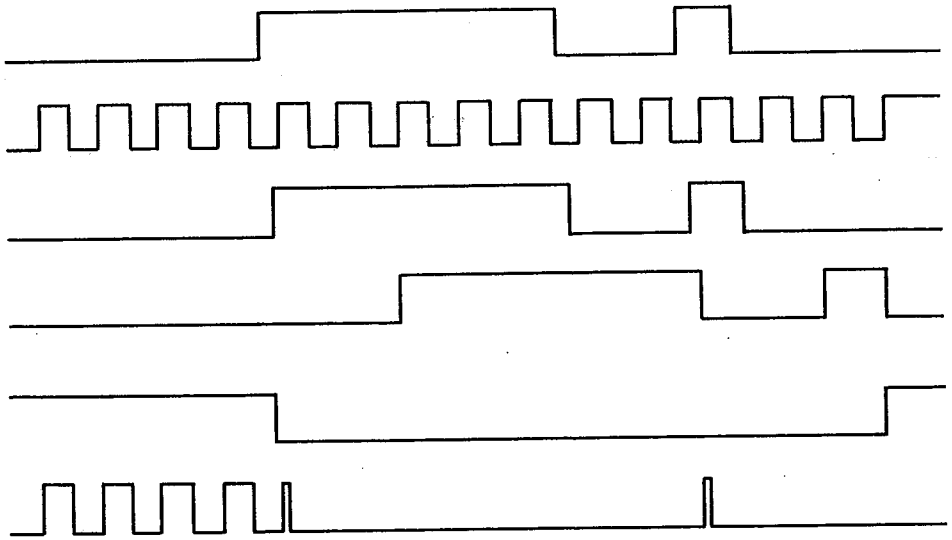
FIGS. 8A through 8F are signal waveforms useful to explain the operation of the time correction circuit shown in FIG. 7.

Suppose now that switch 1 is operated to produce an electric signal as shown in FIG. 8A. FIG. 8B shows the clock pulse CP2 having a frequency of 1 Hz. In the same manner as the previous embodiments shift registers 3 and 6 produce output signals shown in FIGS. 8C and 8D respectively in response to the electric signal applied to the shift register 2 by the operation of the switch 1. The output signals from shift registers 3 and 6 are applied to the inputs of the AND gate circuit 16 together with the outputs from shift registers 4 and 5, respectively through inverters, so that when all these output signals become 0 state, AND gate circuit 16 produces an output signal as shown in FIG. 8E which is used to reset the shift register 17. Thus, so long as the switch 1 is maintained open, the flip-flop circuit 50 is maintained in its reset state. Under this state, an output signal having a logical level 0 is produced on the output terminal Q of the shift register 17 which is applied to the AND gate circuit 20 via inverter 19. In this manner, since AND gate circuit 20 is applied with the inverted signal of the 0 output signal from the shift register the logical condition is satisfied to produce a 1 output signal. As a consequence, the 1 Hz clock pulse CP2 is passed through the AND gate circuit 21 and applied to the counter (not shown) of the timepiece via OR gate circuit 22 for effecting time correction.

Next, a case wherein the switch 1 is closed under these conditions will be considered. Thus, upon closure of the switch 1 the AND gate 18 is enabled to apply its output signal to the terminal $\overline{CP}$ of the shift register 17. Accordingly, a 1 output signal appears at the Q terminal of the shift register 17 which is applied to the AND gate circuit 23 together with the pulse generated by the AND gate circuit 15 when the switch 1 is closed. The output from the AND gate circuit 23 is applied to the set terminals S of the flip-flop circuit 24 whereby a 1 output signal is produced at the output terminal Q of the flip-flop circuit 24 which is applied to OR gate circuit 22 for producing a time correction signal. In response to the output signal appearing at the terminal Q of the shift register 26, the pulse generating circuit 60 produces an output signal on the output terminal Q of the shift register 26 which is delayed about from 1/32 to 1/16 second from the signal produced on the terminal Q of the flip-flop circuit 24 and the delayed signal is applied to the reset terminal R of the flip-flop circuit 24 thus resetting the same.

By operating the switch 1 as above described, a signal as shown in FIG. 8F is generated by the OR gate circuit 22 which is applied to the counter of the electronic timepiece for correcting its time.

What is claimed as new and desired to be secured by Letters Patents of the U.S. is:

1. A time correction circuit for an electronic timepiece comprising a switch; a first shift register circuit including a plurality of cascade connected shift registers which are driven by a clock pulse having a first predetermined frequency for shifting an electric signal produced in response to the operation of said switch; a second shift register circuit including a plurality of cascade connected shift registers which are driven by a clock pulse having a second predetermined frequency lower than said first predetermined frequency for shifting the output signal from said first shift register circuit; a first logical circuit connected to receive the output signals from the shift registers of the first and last stages of said first shift register circuit for producing a pulse corresponding to the electric signal supplied to said first shift register circuit by said switch; and a second logical circuit connected to receive at least the output signals from said first and second shift register circuits and a clock pulse having a third predetermined frequency for producing clock pulses having said third predetermined frequency and whose number corresponds to the interval in which said switch is maintained open or closed when said switch is maintained open or closed for an interval longer than a predetermined interval.

2. A time correction circuit according to claim 1 which further comprises an OR gate circuit connected to receive the output signals from said first and second logical circuits.

3. A time correction circuit according to claim 1 wherein said first shift register circuit includes two shift registers each constructed to invert and shift an input signal applied thereto, said second shift register circuit includes two shift registers each constructed to shift an input applied thereto without inverting the input, said first logic circuit comprises a NOR gate circuit, and said second logic circuit comprises an AND gate circuit.

4. A time correction circuit according to claim 1 wherein said first shift register circuit includes two cascade connected shift registers each constructed to invert and shift an input signal applied thereto, said second shift register circuit includes three cascade connected shift registers each constructed to shift an input applied thereto without inverting the input, said first logic circuit comprises a first AND gate circuit including inverters at the input stage, and said second logic circuit comprises a second AND gate circuit.

5. A time correction circuit according to claim 1 wherein said first shift register circuit comprises two cascade connected shift registers each constructed to invert and shift an input signal applied thereto; said second shift register circuit comprises three cascade connected shift registers each constructed to shift an input signal without inverting the same; said first logical circuit comprises a first AND gate circuit including an inverter in the first stage; and said second logical circuit comprises a second AND gate circuit including an inverter at the first stage, a flip-flop circuit having an input terminal connected to the output terminal of said first shift register circuit and a reset terminal connected to the output terminal of said second AND gate circuit, a third AND gate circuit having an input terminal connected to the output terminal of said first shift register circuit via an inverter, and a fourth AND gate circuit connected to receive the output signal from said third AND gate circuit and a clock pulse having a frequency of 1 Hz, and wherein said time correction circuit further comprises a fifth AND gate circuit connected to receive the outputs from said first AND gate circuit and said flip-flop circuit, and an OR gate circuit connected to receive the outputs from said fourth and fifth AND gate circuits.

6. A time correction circuit according to claim 5 which further comprises a pulse generating circuit responsive to the output signal from said fifth AND gate circuit for applying a pulse corresponding to said output signal to said OR gate circuit.

7. A time correction circuit according to claim 3 which further comprises an OR gate circuit connected to receive the output signals from said NOR gate circuit and said AND gate circuit.

8. A time correction circuit according to claim 7 wherein each shift register of said first shift register circuit is driven by a clock pulse having a frequency of 32 Hz, each shift register of said second shift register circuit is driven by a clock pulse having a frequency of 1 Hz, and said AND gate circuit is connected to receive the output signals from said first and second shift register circuits and a clock pulse having a frequency of 1 to 10 Hz.

9. A time correction circuit according to claim 4 which further comprises an OR gate circuit connected to receive the output signals from said first and second AND gate circuits.

10. A time correction circuit according to claim 9 wherein each shift register of said first shift register circuit is driven by a clock pulse having a frequency of 32 Hz, each shift register of said second shift register circuit is driven by a clock pulse having a frequency of 1 Hz and said second AND gate circuit is connected to receive the output signals from said first and second shift register circuits and the clock pulse having a frequency of 1 Hz.

* * * * *